US007219637B2

(12) United States Patent
Nakayama

(10) Patent No.: US 7,219,637 B2
(45) Date of Patent: May 22, 2007

(54) ENGINE WITH VARIABLE VALUE TIMING DEVICE

(75) Inventor: Yoshiharu Nakayama, Shizuoka-ken (JP)

(73) Assignee: Yamaha Motor Co., Ltd., Shizuoka-ken (JP)

( * ) Notice: Subject to any disclaimer, the term of this patent is extended or adjusted under 35 U.S.C. 154(b) by 0 days.

(21) Appl. No.: 11/226,933

(22) Filed: Sep. 14, 2005

(65) Prior Publication Data

US 2006/0060160 A1 Mar. 23, 2006

(30) Foreign Application Priority Data

Sep. 14, 2004 (JP) ..... 2004-267348

(51) Int. Cl.
*F01L 1/34* (2006.01)

(52) U.S. Cl. ..... 123/90.17; 123/90.15; 123/90.31

(58) Field of Classification Search ..... 123/90.17, 123/90.31, 90.15
See application file for complete search history.

(56) References Cited

U.S. PATENT DOCUMENTS 5,247,914 A * 9/1993 Imai et al. ..... 123/90.17
5,522,352 A * 6/1996 Adachi et al. ..... 123/90.15
5,988,126 A * 11/1999 Strauss et al. ..... 123/90.17

FOREIGN PATENT DOCUMENTS

JP 07-293210 11/1995

* cited by examiner

*Primary Examiner*—Thomas Denion
*Assistant Examiner*—Zelalem Eshete
(74) *Attorney, Agent, or Firm*—Knobbe, Martens, Olson & Bear, LLP

(57) ABSTRACT

An engine includes a variable valve timing device coupled to a camshaft, which operates within a cam chamber of the engine. The variable valve timing device includes a hydraulic pressure switchover valve having an elongated valve body. The switchover valve is disposed outside the cam chamber and is oriented such that a longitudinal axis of the elongated valve body lies generally parallel to a rotational axis of the camshaft. In this manner, the engine size can generally remain compact while still employing a variable valve timing device with a switchover valve.

14 Claims, 6 Drawing Sheets

ENGINE WITH VARIABLE VALUE TIMING DEVICE

CROSS-REFERENCE TO RELATED APPLICATIONS

This application claims the priority benefit under 35 U.S.C. § 119 of Japanese Patent Application No. 2004-267348, which was filed Sep. 14, 2004 and which is hereby incorporated by reference.

BACKGROUND OF THE INVENTION

1. Field of the Invention

The present invention relates to an engine comprising a variable valve timing device that varies phases of a camshaft to vary timing of opening and closing of an intake valve, an exhaust valve, or both.

2. Description of the Related Art

Some engines today include a variable valve timing device that varies the timing for opening and closing intake and exhaust valves in the engine according to the rotating speed of the engine and a load thereon. In most engines, the valves are driven off of the crankshaft in a timed relationship. A crank-side drive member is mounted on a crankshaft and a camshaft drive member is mounted on a camshaft. A timing chain or a timing belt connects these drive members together such that the camshaft(s) rotate together with the crankshaft. The variable valve timing device changes the phase of the camshaft drive member and the camshaft relative to the crank-side drive member using hydraulic pressure. Japanese Patent Publication No. JP-A-07-293210 discloses an example of a variably valve timing device that uses hydraulic pressure to change the phase of the camshaft and the camshaft drive member.

An engine provided with the hydraulic pressure-type variable valve timing device described above needs a hydraulic pressure switchover valve that switches hydraulic pressure to an advance-side or a lag-side of a hydraulic pressure chamber of the variable valve timing device. That is, the switchover valve is used to supply pressurized hydraulic fluid to either the advance-side or lag-side of the hydraulic pressure chamber of the variable valve timing device. Consequently, the variable valve timing device either advances or retards the position of the camshaft relative to the crank-side drive member. The switchover valve typically has an elongated body. In some prior applications, the size of the engine must be enlarged to accommodate the switchover valve within the cylinder head of the engine.

SUMMARY OF THE INVENTION

An aspect of the present invention involves an engine comprising a cylinder head, at least one combustion chamber formed in part by the cylinder head, and at least one cam chamber formed at least in part by the cylinder head. The cylinder head includes at least one port that communicates with the combustion chamber. A valve selectively closes the port, and a camshaft is disposed within the cam chamber to actuate the valve. A variable valve timing device is coupled to the camshaft. The variable valve timing device includes a hydraulic pressure switchover valve that has an elongated valve body. The switchover valve is disposed outside the cam chamber and is oriented such that a longitudinal axis of the elongated valve body lies generally parallel to a rotational axis of the camshaft. With the switchover valve so positioned, the engine can include the variable valve timing device while remaining relatively compact.

In a preferred mode, the cylinder head includes a side wall and the hydraulic pressure switchover valve is disposed to an outer side of the side wall. The switchover valve preferably is arranged to lie generally parallel to the side wall.

In another preferred mode, the engine additionally comprises a camshaft drive member mounted on the camshaft. The hydraulic pressure switchover valve is arranged so that its elongated valve body extends from one side of the camshaft drive member to the other side thereof in a direction along the camshaft.

In a further preferred mode, the hydraulic pressure switchover valve comprises an advanced-side hydraulic pressure outlet and a lag-side hydraulic pressure outlet. The elongated valve body of the switchover valve is arranged in a direction along the camshaft so that the advance-side hydraulic pressure outlet is positioned to one side of the camshaft drive member and the lag-side hydraulic pressure outlet is positioned to the other side of the camshaft drive member.

BRIEF DESCRIPTION OF THE DRAWINGS

These and other features, aspects and advantages of the present invention will now be described in connection with a preferred embodiment of the invention, in reference to the accompanying drawings. The illustrated embodiment, however, is merely an example and is not intended to limit the invention. The drawings include the following 6 figures.

DETAILED DESCRIPTION OF THE PREFERRED EMBODIMENT

Figure 1:
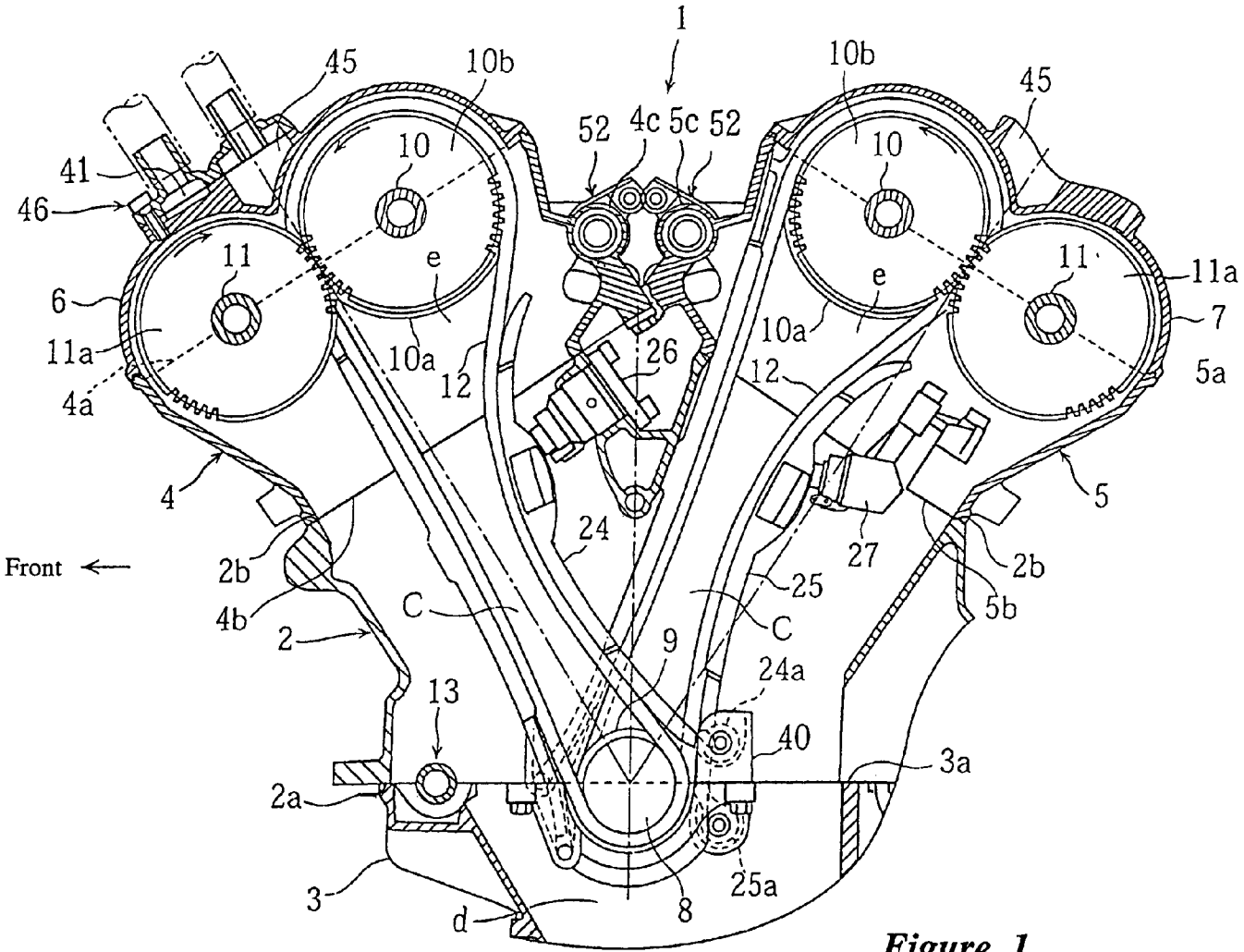
FIG. 1 is a side cross-sectional view showing an engine with a variable valve timing device configured in accordance with a preferred embodiment of the invention.

With reference initially to FIG. 1, reference numeral 1 denotes a water-cooled 4-cycle V-type four-cylinder engine having the following construction. A crankcase 3 is joined to a lower mating surface 2*a* of a cylinder block 2. The cylinder block 2 includes a pair of banks 2*c*, 2*d* that are disposed in a V-shape. The front bank 2*d* defines right and left cylinders 2*e*, 2*f* and the rear bank 2*d* defines rear cylinders 2*e*, 2*f*. The tops of the cylinders are closed by front and rear cylinder heads 4, 5, respectively, which are joined to upper mating surfaces 2*b*, 2*b* of the front and rear banks 2*c*, 2*d* by head bolts. Front and rear head covers 6, 7 are mounted on the front and rear cylinder heads 4, 5 to define cam chambers therebetween.

The described engine, however, is merely an example of an engine type on which the variable valve timing (VVT) mechanism can be employed. The VVT mechanism can also be employed with engines having other numbers of cylinders (e.g., two) and other cylinder arrangements (e.g., straight).

Additionally, various engine components of the illustrated engine are described herein with the engine transversely mounted and with the engines crankshaft disposed generally horizontally, as shown in FIG. 1. Accordingly, the adjectives "front," "rear," "top," "bottom," and similar terms are used in reference to the orientations shown in the drawings and should not limit the invention to this particular engine orientation. In addition, since the front and rear cylinder banks are substantially the same in construction, the construction on the front cylinder bank is mainly described below. This description applies equally to the rear cylinder bank, unless indicated otherwise.

Figure 4:
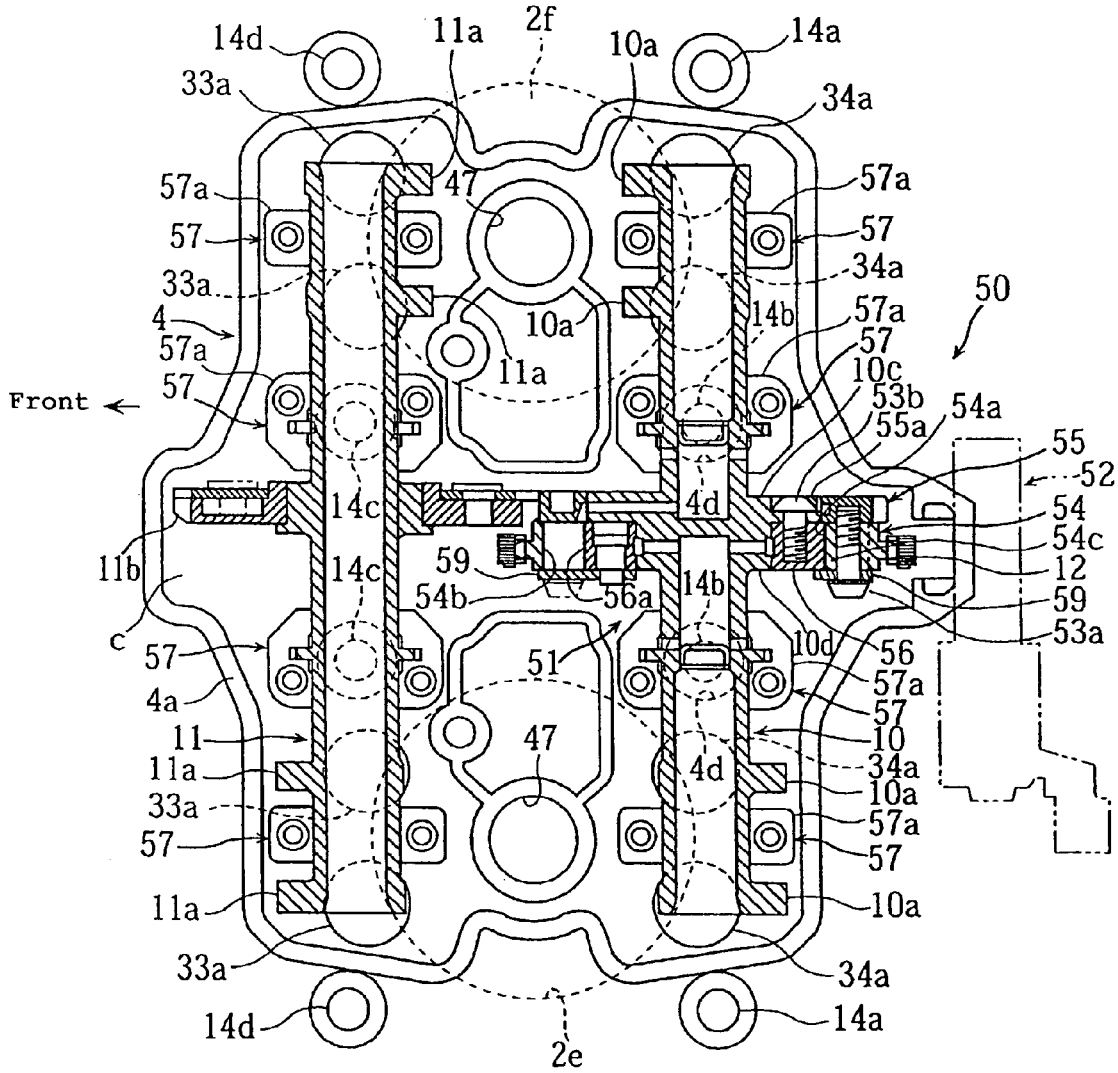
FIG. 4 is a plan view showing, in cross section, camshafts supported by a cylinder head of the engine illustrated in FIG. 3.

As noted above, the front and rear cylinder banks 2*c*, 2*d* are formed with left and right cylinder bores (first and second cylinders) 2*e*, 2*f*, which are aligned two sets by two sets in a direction along a camshaft. The cylinder heads 4, 5 are affixed to the cylinder block 2 by head bolts 14*a*–14*d*, which are arranged around the left and right cylinder bores 2*e*, 2*f*. As best seen in FIG. 4, the head bolts 14*a*, 14*d* are arranged outside the cam chamber, in which camshafts 10, 11 are disposed, and the head bolts 14*b*, 14*c* are arranged inside the cam chamber. The head bolts 14*b*, 14*c* in the cam chamber preferably are positioned just below bearing portions of the camshafts 10, 11, and bolt holes 4*d*, in which heads of the head bolts 14*b* are positioned, serve also as hydraulic pressure supply passages as described in greater detail later.

Also, pistons 31 that are disposed and arranged in the left and right cylinder bores 2*e*, 2*f* are connected through connecting rods 32 to crank pins of a crankshaft 8. The crankshaft 8 is journaled by a journal bearing mechanism, of which left and right journal parts in an axial direction and two central journal parts are formed between the lower mating surface 2*a* of the cylinder block 2 and an upper mating surface 3*a* of the crankcase 3. In addition, the reference numeral 13 denotes a balancer shaft arranged between the mating surfaces 2*a*, 3*a* and in parallel to the crankshaft 8.

Lower mating surfaces 4*b*, 5*b* of the cylinder heads 4, 5 are formed with recesses that, together with the corresponding piston 31 and cylinder 2*e*, 2*f*, form the combustion chambers b. Exhaust ports 36 and intake ports 37, which are also defined by the cylinder head 4, 5 open into the combustion chambers b. Exhaust valves 33 and intake valves 34 are arranged to open and close the openings of the respective ports 36, 37. Lifters 33*a*, 34*a* are mounted at upper ends of the exhaust valves 33 and the intake valves 34, and cam lobes 11*a*, 10*a* of the exhaust camshafts 11 and the intake camshafts 10 rollingly abut against upper surfaces of the lifters 33*a*, 34*a*.

The exhaust camshafts 11 and the intake camshafts 10 are arranged on upper surfaces 4*a*, 5*a* of the cylinder heads 4, 5 to lie parallel to the crankshaft 8. The intake camshafts 10 preferably are arranged toward the inside the V banks, and the exhaust camshafts 11 preferably are arranged toward outside the V banks. In the illustrated embodiment, the camshafts are rotatably supported by four sets of cam bearings 57, respectively. The respective cam bearings 57 are arranged in positions corresponding to respective centers of the left and right cylinder bores 2*e*, 2*f* and arranged on both sides thereof. In these positions, the two center cam bearing 57 interpose a chain chamber c that is formed in a central region in a transverse direction of the engine. The cam bearings 57 preferably comprise a bearing body 57*a* formed on a cylinder head side and a cam cap 57*b* bolted and detachably mounted to the bearing body.

Ignition plugs 48 are disposed substantially centrally of the cylinder heads 4, 5, and electrodes of the ignition plugs 48 are positioned substantially on an axis of the corresponding cylinder 2*e*, 2*f*. The ignition plugs 48 are mounted and dismounted through plug holes 47 formed in the cylinder covers and cylinder heads. Also, the reference numerals 24, 25 denote tensioner members that adjust tension of timing chains 12, 12. Lower ends 24*a*, 25*a* of the tensioner members 24, 25 preferably are pivotally supported by a holding member 40, which is mounted to the lower mating surface 2*a* of the cylinder block 2. Also, upper portions of the tensioner members 24, 25 are biased by bias mechanisms 26, 27 in directions in which tension is imparted to the timing chains 12.

In the illustrated embodiment of the engine 1, the intake ports 37 extend upwardly, and throttle bodies 35 are connected to outside connection openings 37*a* at upper ends of the intake ports. The throttle bodies 35 preferably house a downstream throttle valve 35*a* and an upstream throttle valve 35*b*. Fuel injection valves 38*a* are disposed generally in the valley of the V-bank engine and are arranged to inject fuel toward the combustion chamber openings of the intake ports 37. Of course, other types of charge formers (e.g., carburetor, direct fuel injector, etc.) can be used as well.

Crank sprockets 9, 9 for the front and rear cylinders are formed centrally of the crankshaft 8 in the axial direction. Also, a cam sprocket (a camshaft drive member) 54 is mounted substantially centrally of the intake camshaft 10 in the axial direction to drive the intake camshaft 10. A timing chain 12 connects the cam sprocket 54 with the crank sprocket 9 so that the sprockets rotate together.

Also, an intake-side timing gear 55 is mounted centrally on the intake camshaft 10 in the axial direction to be able to drive the corresponding exhaust camshaft 11. The intake-side timing gear 55 is clamped and fixed to the cam sprocket 54 by bolts 53*a* to be able to rotate the cam sprocket 54.

The intake-side timing gear 55 meshes with an exhaust timing gear 11*a*, which is mounted on the exhaust camshaft 11 so as to rotate therewith. With such construction, rotation of the crankshaft 8 is transmitted through the cam sprocket 54 and the intake-side timing gear 55 to the intake camshaft 10 by the timing chain 12, and rotation of the intake camshaft 10 is transmitted through the timing gears 55, 11*b* to the exhaust camshaft 11. The exhaust and intake camshafts 11, 10 rotate whereby the exhaust valves 33 and the intake valves 34 move to open and close exhaust valve openings and intake valve openings of the exhaust and intake ports 36, 37, respectively.

The chain chamber c is formed on those portions of the crankcase 3, the cylinder block 2, and the cylinder heads 4, 5, which lie between the left and right cylinder bores 2*e*, 2*f*, so as to provide communication between the crank chamber d and the cam chamber e. The exhaust-side and intake-side timing gears 11*a*, 55, the cam sprocket 54, the timing chain 12, and the crank sprocket 9 are positioned generally in the chain chamber c, which extends substantially parallel to the axes of the cylinders 2*e*, 2*f*. Additionally, in the illustrated embodiment, the reference numeral 41 denotes an air introduction chamber formed across the chain chamber c to introduce secondary air into an exhaust system, the reference numeral 45 denotes a breather chamber, in which mist oil is separated from a blowby gas, and the reference numeral 46 denotes a common cover that covers the breather chamber 45 and the air introduction chamber 41.

The engine 1 comprises a variable valve timing device 50 that, in the illustrated embodiment, varies the timings of opening and closing of the intake valves 34. The variable valve timing device 50 comprises a phase varying mechanism 51, which varies the timing phases of the intake camshaft 10, the cam sprocket 54, and the intake-side timing gear 55, and a hydraulic pressure switchover valve 52. The hydraulic pressure switchover valve 52 is used to switch supplying pressurized hydraulic fluid between an advance hydraulic pressure chamber A or a lag hydraulic pressure chamber B of the phase varying mechanism 51.

Figure 3:
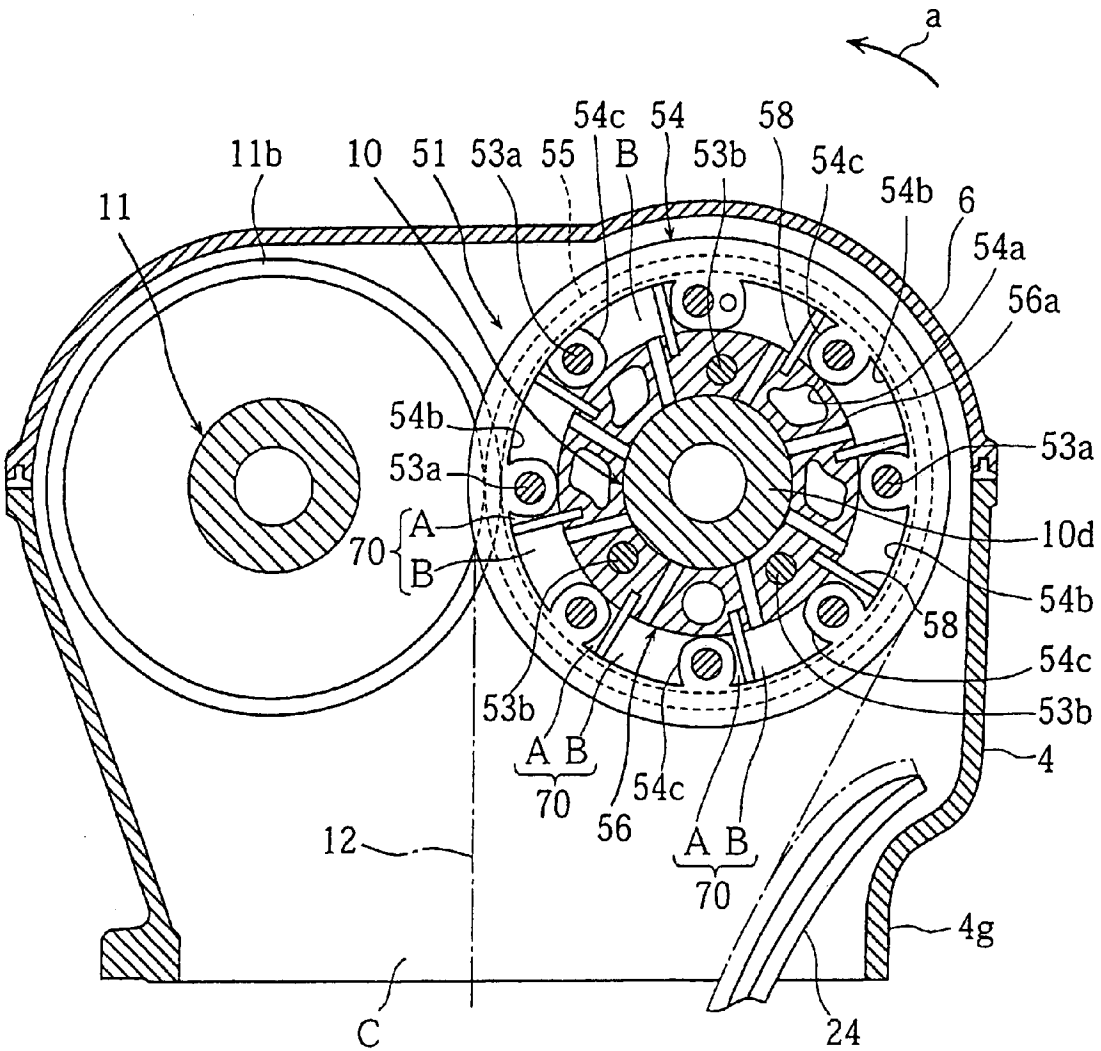
FIG. 3 is a sectional view through a cylinder head of the engine of FIG. 2 showing a phase variable mechanism of the variable valve timing device.
Figure 5:
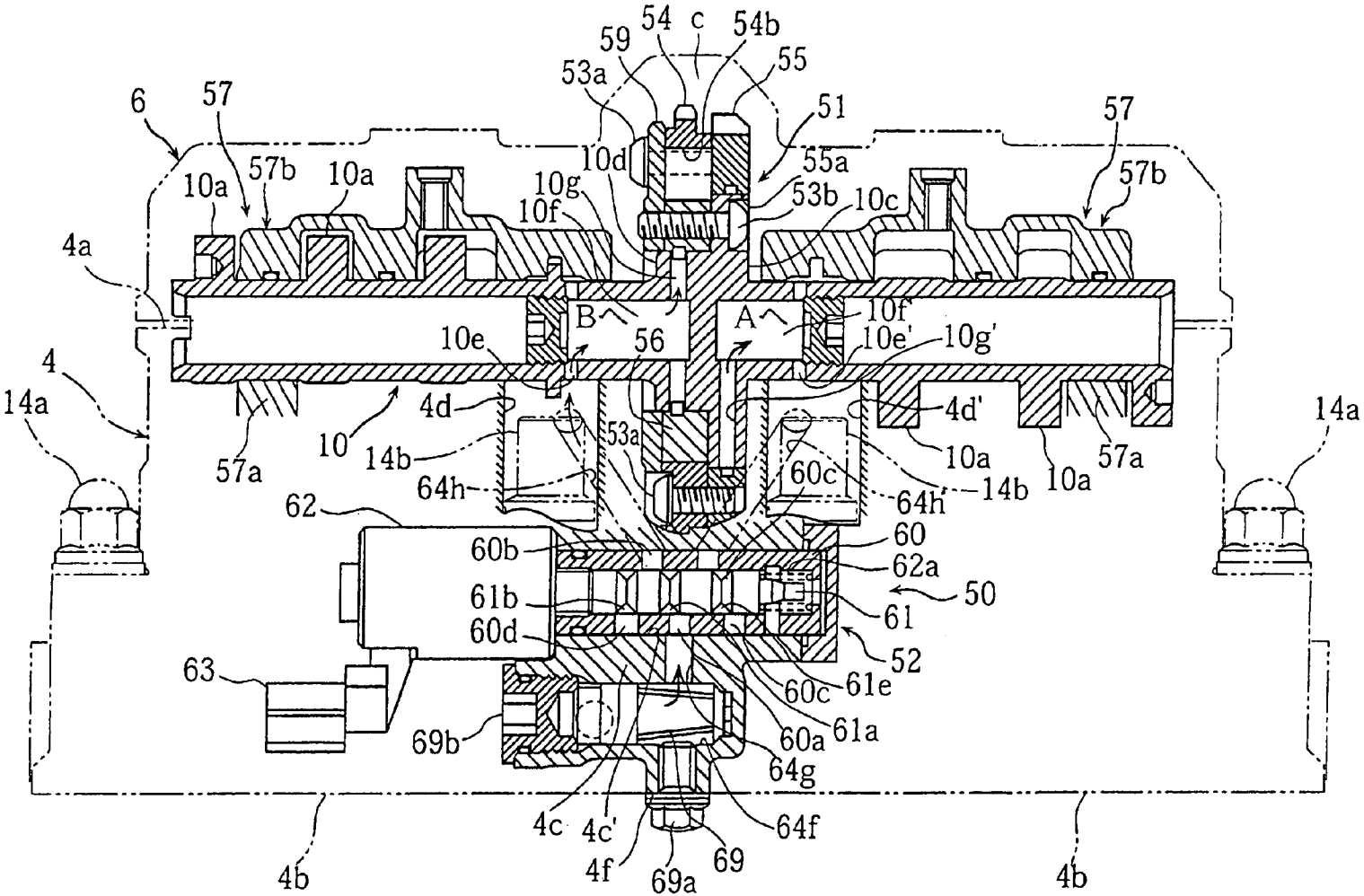
FIG. 5 is a front view showing, in cross section, a hydraulic pressure switchover valve of the variable valve timing device.
Figure 6:
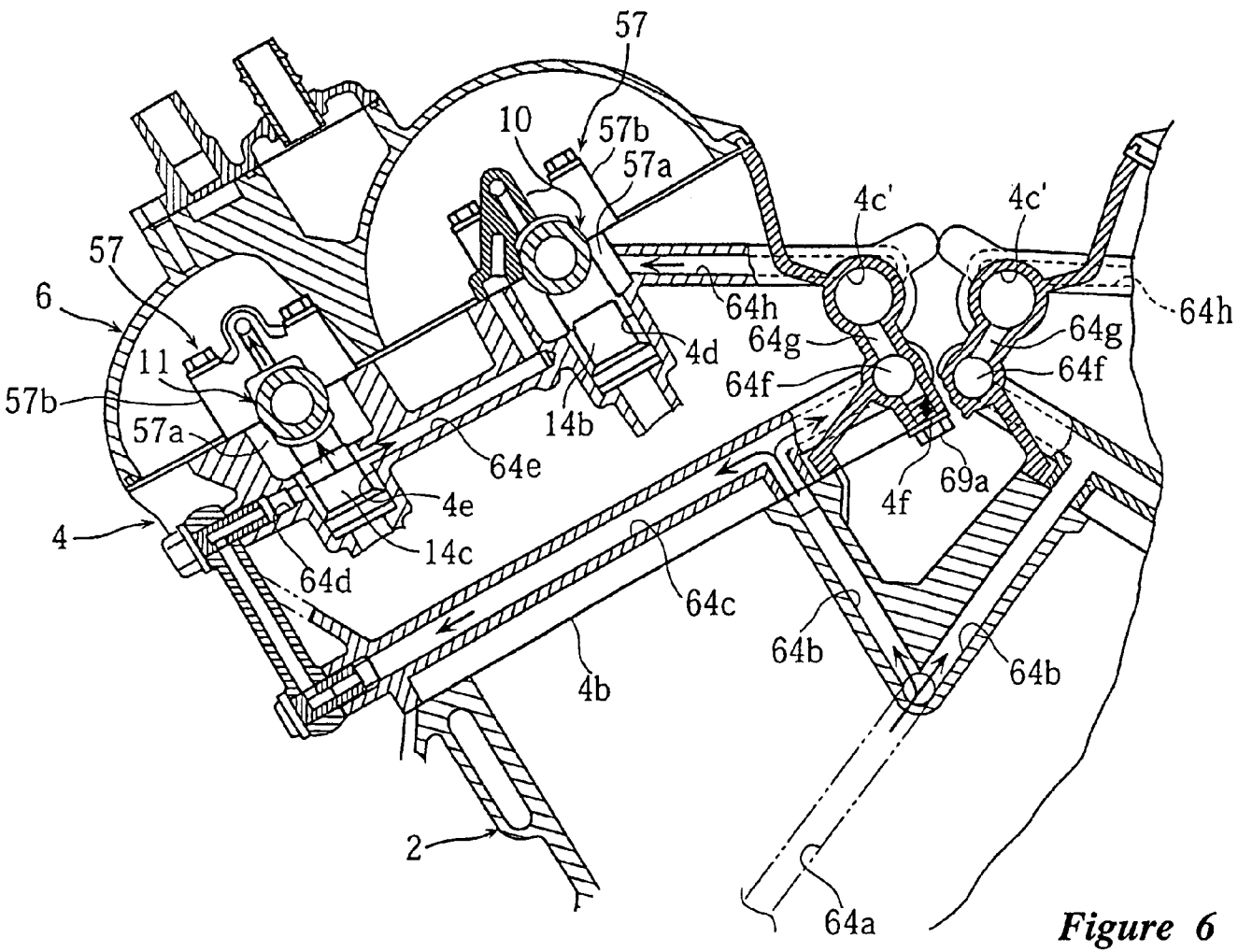
FIG. 6 is a side view showing, in cross section, a hydraulic supply path of the variable valve timing device.

The phase varying mechanism 51 preferably is constructed in the following manner. As best seen in FIGS. 3–5, an inner peripheral surface of a ring-shaped inner rotor 56 is fitted onto an outer peripheral surface of a boss portion 10*d* in an oil-tight manner. The boss portion 10*d* lies substantially at central portion of the intake camshaft 10 in the axial direction and has an enlarged diameter. The inner rotor 56 is clamped and fixed to a side of a flange portion 10*c* by bolt 53*b*. The flange portion 10*c* is an axial edge of the boss portion 10*d* that has a further enlarged diameter. Also, an inner peripheral surface 54*a* of the cam sprocket 54 slides over an outer peripheral surface 56*a* of the inner rotor 56 so as to rotate thereto in an oil-tight manner. The inner peripheral surface 54*a* of the cam sprocket 54 is formed at eight locations thereof in a concave manner with recesses 54*b* with the result that portions between the respective recesses 54*b* define inwardly projecting boss portions 54*c*. Inner surfaces of the boss portions 54*c* come into sliding contact with the outer peripheral surface 56*a* of the inner rotor 56. In addition, a seal member may be interposed between the boss portions 54*c* and the outer peripheral surface 56*a*. Bolts 53*a* are inserted through the boss portions 54*c*.

An inner peripheral surface 55*a* of the intake-side timing gear 55 slides relative to an outer peripheral surface of the flange portion 10*c* so as to rotate relative thereto in an oil-tight manner. Further, a cover plate 59 is arranged to cover the recesses 54*b* and, by threading the bolt 53*b* into the timing gear 55, the cover plate 59 is fixed to interpose the cam sprocket 54 between it and the timing gear. In this manner, a space surrounded by the recesses 54*b* of the cam sprocket 54, the outer peripheral surface of the inner rotor 56, the intake-side timing gear 55, and the cover plate 59 defines a hydraulic pressure chamber 60.

Furthermore, vanes 58 extend from the outer peripheral surface of the inner rotor 56 into the hydraulic pressure chamber 60. The vanes 58 are biased radially outward so as to come into sliding contact with inner peripheral surfaces of the recesses 54*b* of the cam sprocket 54. The vanes 58 compartmentalize the hydraulic pressure chamber 60 into the advance hydraulic pressure chambers A and the lag hydraulic pressure chambers B.

With such construction, when hydraulic pressure is supplied to the advance hydraulic pressure chambers A, the camshaft 10 rotates counterclockwise relative to the cam sprocket 54 and the intake-side timing gear 55 in FIG. 4 so that the intake valves 34 vary toward an advance side in the timing of their opening and closing.

In addition, those portions of the inner rotor 56, to which the vanes 58 are mounted, may be made to project radially outward so that the projecting portions function as vanes. In this case, seal members are interposed between the projecting portions and the inner peripheral surfaces of the recesses 54*b*.

The hydraulic pressure switchover valve 52 preferably is arranged substantially in parallel to the camshaft 10 on the cylinder head 4, outside an inner wall 4*g* positioned toward the valley of V-shaped banks, and substantially in parallel to the camshaft 10. Also, the hydraulic pressure switchover valve 52 preferably is arranged in a manner to be positioned between a plane including the head-cover side mating surface 4*a* of the cylinder head 4 and a plane including the cylinder-block side mating surface 4*b*. While in the illustrated embodiment, the orientation of the hydraulic pressure switchover valve 52 meets both of these criteria, it is understood that, in some applications, both criteria need not be met.

Figure 2:
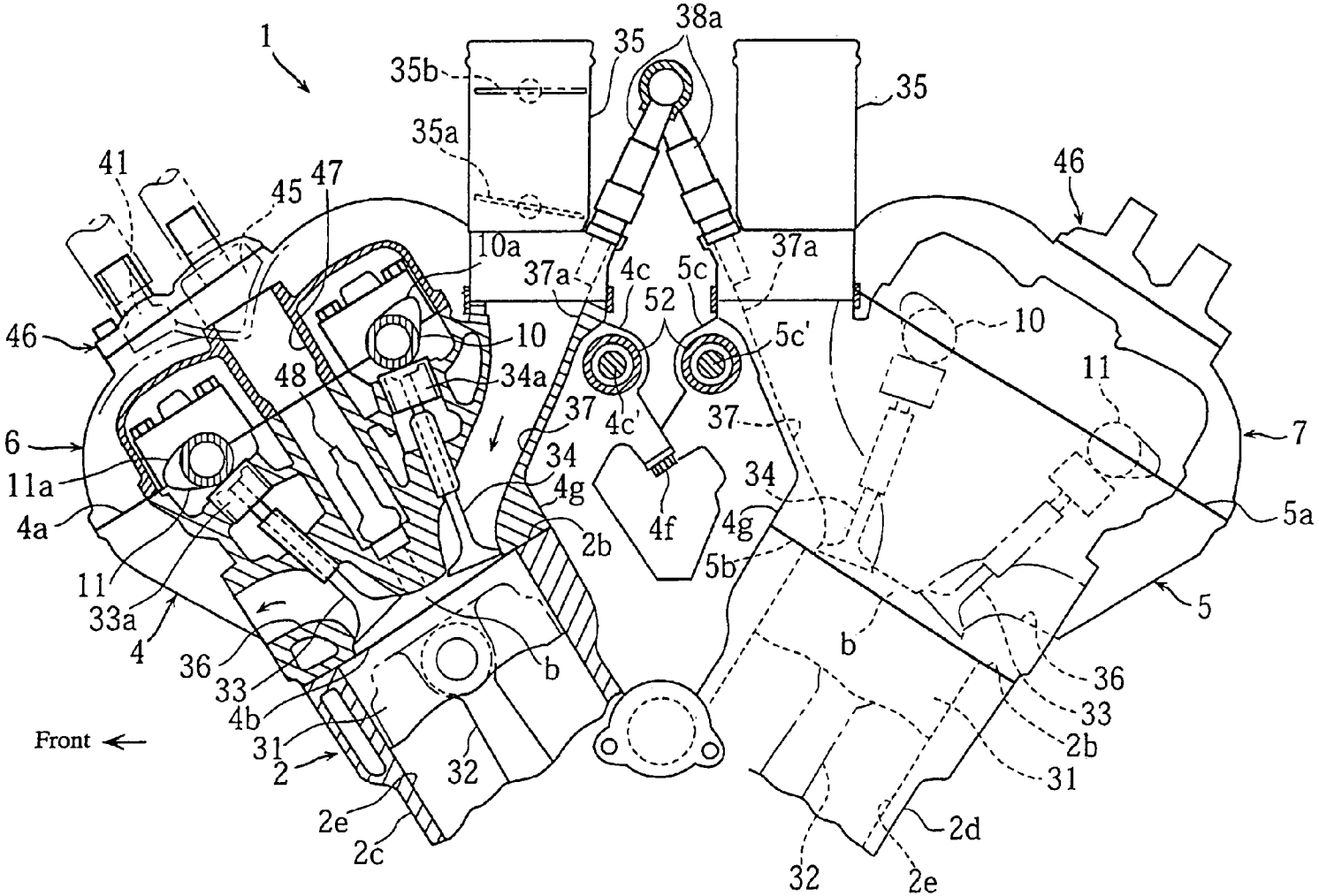
FIG. 2 is an enlarged partial sectional, side view showing cylinder heads and upper portions of cylinders of the engine shown in FIG. 1.

As best seen in FIG. 2, valve support bosses 4*c*, 5*c* are formed integral with V-bank side inner walls of the cylinder heads 4, 5 to be positioned in the valley of the V banks, and the hydraulic pressure switchover valve 52 is inserted into support holes 4*c*', 5*c*' of the valve support bosses 4*c*, 5*c*.

In the illustrated embodiment, the hydraulic pressure switchover valve 52 is generally rod-shaped to comprise a cylinder-shaped cylinder 60, a rod-shaped valve body 61 inserted into and arranged in the cylinder 60 to be able to advance and retreat, and a solenoid (electromagnetic actuator) 62 arranged at one end of the cylinder 60 to drivingly advance and retreat the valve body 61.

Formed concavely on an outer peripheral surface of the valve body 61 are an introduction recess 61*a* in a central vicinity in an axial direction, and drain recesses 61*b*, 61*c* on both sides of the introduction recess. Also, an introduction hole 60*a*, a lag-side outlet 60*b*, an advance-side outlet 60*c*, and drain holes 60*d*, 60*e* are formed in a wall of the cylinder 60 in a manner to provide communication between the inside and outside of the cylinder. In addition, the drain holes 60*d*, 60*e* preferably communicate with an interior of an oil pan through drain passages (not shown). Reference numeral 62*a* denotes a return spring that biases the valve body 61 toward a retreat end position (a position indicated by solid lines in FIG. 5).

The hydraulic pressure switchover valve 52 is arranged so that the introduction hole 60*a* is disposed substantially centrally of the engine 1 in a direction along the camshaft, that is, in substantially the same position as that of the cam sprocket 54 in the direction along the camshaft. Also, the lag-side outlet 60*b* and the advance-side outlet 60*c* are arranged to be positioned in the neighborhood of one side and the other side of the cam sprocket 54.

The introduction hole 60*a*, the lag-side outlet 60*b*, and the advance-side outlet 60*c* are positioned as described above with the result that the valve body 61 is positioned in a manner to axially bridge the cam sprocket 54, and the solenoid 62 is positioned in a manner to overlap an axis of the left cylinder bore 2*e* positioned on a left side of the cam sprocket 54 as viewed in a direction perpendicular to the camshaft. Also, the solenoid 62 and a connector 63 are positioned in a projected plane in a direction perpendicular to the axis of the left cylinder bore 2*e* and the camshaft as viewed in a direction along the axis of the cylinder bore (see FIG. 4).

The connector 63 preferably is formed at an axial end of the solenoid 62 for external connection to supply electrical power to the solenoid 62. The connector 63 is formed so that a direction, in which feed wiring is connected, is made generally in parallel to the camshaft and is positioned toward an axially outer end of the camshaft.

A hydraulic pressure supply system to supply the phase varying mechanism 51 is used partially in common with a camshaft lubrication system. More specifically, an oil passage 64*a* connected to an oil pump (not shown) branches into front and rear cylinder branch passages 64*b*, 64*b* in the vicinity of a V bank bottom of the cylinder block 2, and the respective cylinder branch passages 64*b* communicate with cylinder branch passages 64*c*, which are arranged in the vicinity of the lower mating surfaces of the cylinder heads 4, 5. One end of the cylinder branch passage 64*c* communicates with the cam bearings 57 of the exhaust camshaft 11 through exhaust-side head bolt holes 4*e* from exhaust camshaft side branch passages 64*d*, and further communicates with the cam bearings 57 of the intake camshaft 10 through intake camshaft side branch passages 64*e*.

The other end of the cylinder branch passage 64*c* is connected to an oil filter chamber 64*f*, which is formed integral with a lower portion of the valve support boss 4*c*, and an outlet 64*g* of the oil filter chamber 64*f* is connected to the introduction hole 60*a* of the cylinder 60. In addition, a cylindrical-shaped oil filter 69 is arranged in the oil filter chamber 64*f*. Maintenance, such as exchange or the like, of the oil filter 69 can be made by removing a cap 69*b* that opens and closes an outer opening of the oil filter chamber 64*f*. Also, the reference numeral 69*a* denotes a plug bolt that closes a work hole when the outlet 64*g* is drilled.

The lag-side outlet 60*b* of the cylinder 60 communicates with the intake-side head bolt hole 4*d* through a lag-side head passage 64*h*, and the head bolt hole 4*d* is connected through a communication hole 10*e* to a lag-side camshaft passage 10*f* in the intake camshaft 10 and further communicated through a supply hole 10*g* to the lag hydraulic pressure chambers B. Likewise, the advance-side outlet 60*c* communicates with to the advance hydraulic pressure chambers A through an advance-side head passage 64*h*', an advance-side head bolt hole 4*d*', a communication hole 10*e*', an advance-side camshaft passage 10*f*, and a supply hole 10*g*'.

When an electric source is set OFF and an engine rotating speed is at most a predetermined rotating speed, the device according to the illustrated embodiment is put in a state shown in FIG. 5, in which timing of opening and closing of the intake valves 34 is put in a non-advance state ("a lag state"). More specifically, the valve body 61 of the hydraulic pressure switchover valve 52 is moved to the retreat end position, shown in FIG. 5, by the return spring 62*a*, so that the introduction recess 61*a* and the lag-side outlet 60*b* communicate with each other. Therefore, hydraulic pressure is supplied to the lag hydraulic pressure chambers B through the lag-side outlet 60*b*, the lag-side head passage 64*h*, the intake-side head bolt hole 4*d*, the lag-side camshaft passage 10*f*, and the supply hole 10*g*. In the phase varying mechanism 51, the lag hydraulic pressure chambers B expands to its maximum size in opening degree, as shown in FIG. 3, the intake camshaft 10 is in a position rotated clockwise relative to the cam sprocket 54, and timing of opening and closing of the intake valves is put in a lag state.

When an engine rotating speed exceeds a predetermined rotating speed, the solenoid 62 drives the valve body 61 toward an advance side to provide communication between the introduction recess 61*a* and the advance-side outlet 60*c*. In this manner, hydraulic pressure is supplied to the advance hydraulic pressure chambers A through the advance-side outlet 60*c*, the advance-side head passage 64*h*', the advance-side head bolt hole 4*d*', the communication hole 10*e*', the advance-side camshaft passage 10*f*, and the supply hole 10*g*'. Then the advance hydraulic pressure chambers A are expanded, and the intake camshaft 10 correspondingly rotates counterclockwise in FIG. 3; that is, rotates in a direction of an arrow a, whereby timing of opening and closing of the intake valves 34 advances. In addition, oil in the lag hydraulic pressure chambers B flows in a reverse direction to that when hydraulic pressure is supplied, and passes through the drain hole 60*d* from the drain recess 61*b* to be recovered in the oil pan.

In the device, according to the embodiment, operating in this manner, the hydraulic pressure switchover valve 52 is arranged substantially parallel to the camshaft 10 outside the inner wall 4*g* of the cylinder head 4, so that even when the hydraulic pressure switchover valve 52 is rod-shaped and relatively lengthy, it can be accommodated within an engine width. The hydraulic pressure switchover valve does not project outside an engine as in the case where it is arranged normal to the camshaft, thus enabling avoiding over sizing of an engine.

Also, since the hydraulic pressure switchover valve 52 is arranged such that the valve body 61 extends from one side of the cam sprocket 54 to the other side thereof in the direction along the camshaft—more specifically, the lag-side hydraulic pressure outlet 60*b* is positioned on the one side in the direction along the camshaft and the advance-side hydraulic pressure outlet 60*c* is positioned on the other side—the rod-shaped hydraulic pressure switchover valve 52 can be arranged making effective use of that extension of the cylinder head 4 in the direction along the camshaft. This arrangement works especially well where the cam sprocket 54 is centrally disposed on the camshaft, so that it is possible to avoid outward projection of the hydraulic pressure switchover valve 52 in the direction along the camshaft, thus enabling avoiding over sizing of an engine in the direction along the camshaft.

Also, the solenoid 62 connected to and arranged at one end of the cylinder 60 is positioned toward the left cylinder bore 2*e* positioned on one side of the cam sprocket 54, whereby outward projection of the solenoid 62 in the direction along the camshaft can be avoided. This arrangement too avoids over sizing of an engine in the direction along the camshaft.

Because the solenoid connector 63 is formed at an outer end in the direction along the camshaft and the direction of connection is made substantially in parallel to the camshaft, the work of connecting the feed wiring to the connector 63 is made easier. Furthermore, it is possible to prevent the connected feed wiring from projecting in a direction perpendicular to the camshaft, which also enables avoiding over-sizing of an engine.

Since the hydraulic pressure switchover valve 52 is arranged in a manner to be positioned between a plane including the head-cover side mating surface 4*a* of the cylinder head 4 and a plane including the cylinder-block side mating surface 4*b*, workability can be improved when a valve operating mechanism and the hydraulic pressure switchover valve 52 are assembled to the cylinder head 4. That is, the work of assembling the valve operating mechanism, etc. to the cylinder head 4 is conducted in a state, in which the mating surfaces 4*a*, 4*b* of the cylinder head 4 on a head cover side or a cylinder block side are caused to face downward and placed on an assembly base or the like. Because the hydraulic pressure switchover valve 52 is positioned between the both mating surfaces 4*a*, 4*b*, the hydraulic pressure switchover valve 52 does not interferes with the assembly base, etc., thus eliminating a problem that the assembly is worsened by locating the hydraulic pressure switchover valve 52 on the exterior of the cylinder head.

Also, since a lower end surface 4*f* of the valve support boss 4*c* is made flush with the cylinder-block side mating surface 4*b* of the cylinder head 4, machining of the lower end surface 4*f* can be conducted simultaneously when machining of the cylinder-block side mating surface 4*b*. The machining costs and time thus are not significantly increased by machining of the lower end surface 4*f* of the valve support boss.

In addition, instead of plugging a worked hole of the outlet 64*g* with the plug bolt 69*a*, a plug ball may be press fitted into the worked hole to achieve plugging. In this case, machining of the lower end surface 4*f* can be dispensed with by positioning the lower end surface above the mating surface 4*b*.

Although this invention has been disclosed in the context of a certain preferred embodiment and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Further, by listing method steps in a particular order within a claim, no intention is made to limit the scope of the claim to that particular order. Thus, it is intended that the scope of the present invention herein disclosed should not be limited by the particular disclosed embodiments described above, but should be determined only by a fair reading of the claims that follow.

What is claimed is:

1. An engine comprising a cylinder head, at least one combustion chamber formed in part by the cylinder head, at least one cam chamber formed at least in part by the cylinder head, the cylinder head including at least one port communicating with the combustion chamber, a valve selectively closing the port, a camshaft disposed within the cam chamber to actuate the valve, and a variable valve timing device coupled to the camshaft and including a hydraulic pressure switchover valve, the hydraulic pressure switchover valve having an elongated valve body and being disposed outside the cam chamber and oriented such that a longitudinal axis of the elongated valve body lies generally parallel to a rotational axis of the camshaft, wherein the cylinder head includes a side wall and the hydraulic pressure switchover valve is disposed to an outer side of the side wall and arranged to lie generally parallel to the side wall and the engine additionally comprising a camshaft drive member mounted on the camshaft, and the hydraulic pressure switchover valve being arranged so that the elongated valve body extends from one side of the camshaft drive member to the other side thereof in a direction along the camshaft.

2. The engine of claim 1, wherein the hydraulic pressure switchover valve comprises an advanced-side hydraulic pressure outlet and a lag-side hydraulic pressure outlet, and the elongated valve body is arranged in a direction along the camshaft so that the advance-side hydraulic pressure outlet is positioned to one side of the camshaft drive member and the lag-side hydraulic pressure outlet is positioned to the other side of the camshaft drive member.

3. The engine of claim 2 additionally comprising at least another combustion chamber, each combustion chamber being formed in part by a cylinder, the cylinders lying generally next to each other in the direction along the camshaft with the camshaft drive member disposed between the cylinders in the direction along the camshaft, and the hydraulic pressure switchover valve including an electromagnetic actuator at one end of the cylinder to drivingly advance and retreat the valve body, and the electromagnetic actuator is arranged to overlap an axis of the cylinder on the one side as viewed in a direction perpendicular to the camshaft.

4. The engine of claim 3, wherein the electromagnetic actuator comprises an electrical connector at an outer end thereof in the direction along the camshaft and the connector is formed so that a direction of connection is made substantially in parallel to the camshaft.

5. The engine of claim 2, wherein the hydraulic pressure switchover valve is supported on a valve support boss, which is formed integral with one side wall of the cylinder head, and arranged to be positioned between a plane including a head-cover side mating surface of the cylinder head and a plane including a cylinder-block side mating surface of the cylinder head.

6. The engine of claim 2 additionally comprising a pair of cylinder banks arranged in a V-shape, and a hydraulic pressure switchover valve for one or more cylinders of one of the cylinder banks and another hydraulic pressure switchover valve for one or more cylinders of the other cylinder bank.

7. An engine comprising a cylinder head, at least one combustion chamber formed in part by the cylinder head, at least one cam chamber formed at least in part by the cylinder head, the cylinder head including at least one port communicating with the combustion chamber, a valve selectively closing the port, a camshaft disposed within the cam chamber to actuate the valve, a variable valve timing device coupled to the camshaft and including a hydraulic pressure switchover valve, the hydraulic pressure switchover valve having an elongated valve body and being disposed outside the cam chamber and oriented such that a longitudinal axis of the elongated valve body lies generally parallel to a rotational axis of the camshaft and a camshaft drive member mounted on the camshaft, and the hydraulic pressure switchover valve being arranged so that the elongated valve body extends from one side of the camshaft drive member to the other side thereof in a direction along the camshaft.

8. The engine of claim 7, wherein the hydraulic pressure switchover valve comprises an advanced-side hydraulic pressure outlet and a lag-side hydraulic pressure outlet, and the elongated valve body is arranged in a direction along the camshaft so that the advance-side hydraulic pressure outlet is positioned to one side of the camshaft drive member and the lag-side hydraulic pressure outlet is positioned to the other side of the camshaft drive member.

9. The engine of claim 8 additionally comprising at least another combustion chamber, each combustion chamber being formed in part by a cylinder, the cylinders lying generally next to each other in the direction along the camshaft with the camshaft drive member disposed between the cylinders in the direction along the camshaft, and the hydraulic pressure switchover valve including an electromagnetic actuator at one end of the cylinder to drivingly advance and retreat the valve body, and the electromagnetic actuator is arranged to overlap an axis of the cylinder on the one side as viewed in a direction perpendicular to the camshaft.

10. The engine of claim 9, wherein the electromagnetic actuator comprises an electrical connector at an outer end thereof in the direction along the camshaft and the connector is formed so that a direction of connection is made substantially in parallel to the camshaft.

11. The engine of claim 7, wherein the hydraulic pressure switchover valve is supported on a valve support boss, which is formed integral with one side wall of the cylinder head, and arranged to be positioned between a plane including a head-cover side mating surface of the cylinder head and a plane including a cylinder-block side mating surface of the cylinder head.

12. The engine of claim 7 additionally comprising a pair of cylinder banks arranged in a V-shape, and a hydraulic pressure switchover valve for one or more cylinders of one of the cylinder banks and another hydraulic pressure switchover valve for one or more cylinders of the other cylinder bank.

13. An engine comprising a cylinder head, at least one combustion chamber formed in part by the cylinder head, at least one cam chamber formed at least in part by the cylinder head, the cylinder head including at least one port communicating with the combustion chamber, a valve selectively closing the port, a camshaft disposed within the cam chamber to actuate the valve, and a variable valve timing device coupled to the camshaft and including a hydraulic pressure switchover valve, the hydraulic pressure switchover valve having an elongated valve body and being disposed outside the cam chamber and oriented such that a longitudinal axis of the elongated valve body lies generally parallel to a rotational axis of the camshaft, wherein the hydraulic pressure switchover valve is supported on a valve support boss, which is formed integral with one side wall of the cylinder head, and arranged to be positioned between a plane including a head-cover side mating surface of the cylinder head and a plane including a cylinder-block side mating surface of the cylinder head.

14. The engine of claim 13 additionally comprising a pair of cylinder banks arranged in a V-shape, and a hydraulic pressure switchover valve for one or more cylinders of one of the cylinder banks and another hydraulic pressure switchover valve for one or more cylinders of the other cylinder bank.

* * * * *